US008430713B2

(12) United States Patent
Willett et al.

(10) Patent No.: US 8,430,713 B2
(45) Date of Patent: Apr. 30, 2013

(54) THREE WHEELED TOY VEHICLE

(75) Inventors: William Willett, Irvine, CA (US); Chung Ming (Bryan) Cheng, Hong Kong (HK); Chun Wing (Edward) Wong, Hong Kong (HK)

(73) Assignee: Mattel, Inc., El Segundo, CA (US)

( * ) Notice: Subject to any disclaimer, the term of this patent is extended or adjusted under 35 U.S.C. 154(b) by 320 days.

(21) Appl. No.: 12/487,779

(22) Filed: Jun. 19, 2009

(65) Prior Publication Data

US 2009/0280718 A1 Nov. 12, 2009

Related U.S. Application Data

(63) Continuation of application No. PCT/US2007/083000, filed on Oct. 30, 2007.

(60) Provisional application No. 60/870,748, filed on Dec. 19, 2006, provisional application No. 60/953,636, filed on Aug. 2, 2007.

(51) Int. Cl.
*A63H 17/26* (2006.01)

(52) U.S. Cl.
USPC ..... 446/470

(58) Field of Classification Search ..... 446/470
See application file for complete search history.

(56) References Cited

U.S. PATENT DOCUMENTS

| | | | |
|---|---|---|---|
| 3,048,447 | A | 8/1962 | Klint |
| 3,733,739 | A | 5/1973 | Terzian |
| 3,746,118 | A | 7/1973 | Altorfer |

(Continued)

FOREIGN PATENT DOCUMENTS

| | | | |
|---|---|---|---|
| DE | 4135585 | A1 | 5/1993 |
| DE | 19513649 | A1 | 10/1996 |

(Continued)

OTHER PUBLICATIONS

Int'l Search Report issued May 15, 2008 in Int'l Application No. PCT/US07/83000; Written Opinion.

(Continued)

*Primary Examiner* — Michael Dennis
(74) *Attorney, Agent, or Firm* — Panitch Schwarze Belisario & Nadel LLP

(57) ABSTRACT

A motorized toy vehicle comprising a chassis with opposing, top and bottom sides and opposing, first and second longitudinal ends and a central plane extending in a vertical direction and a longitudinal direction through the chassis and at least generally bisecting the sides and ends; first and second wheels coupled with the chassis proximal the first end so as to pivot with respect to the chassis and steer the first end, the first and second wheels being located on opposite sides of the central plane; a third wheel coupled with the chassis proximal the second end so as to span the central plane and pivot with respect to the chassis at least along an axis located in the central plane, the axis being pitched away from the vertical direction and toward the longitudinal direction in the central plane; and a steering coupling operably connecting the first and second wheels with the third wheel to simultaneously pivot the first, second and third wheels with respect to the chassis so as to steer the toy vehicle at the first and second ends of the chassis in a selected direction.

20 Claims, 15 Drawing Sheets

U.S. PATENT DOCUMENTS

| | | | | |
|---|---|---|---|---|
| 3,958,814 | A | 5/1976 | Smith | |
| 4,132,435 | A | 1/1979 | Wilson | |
| 4,299,301 | A | 11/1981 | Janin | |
| 4,502,560 | A | 3/1985 | Hisatomi | |
| 4,526,392 | A | 7/1985 | Berkstresser | |
| 4,693,696 | A | 9/1987 | Buck | |
| 4,703,824 | A | 11/1987 | Irimajiri et al. | |
| 4,832,651 | A | 5/1989 | Buck | |
| 4,903,857 | A | 2/1990 | Klopfenstein | |
| 4,966,569 | A | 10/1990 | Asano | |
| 4,993,733 | A | 2/1991 | Eilers | |
| 6,551,169 | B2 | 4/2003 | Jaffe | |
| 6,648,722 | B2 | 11/2003 | Lynders et al. | |
| 6,692,333 | B2 | 2/2004 | Kislevitz et al. | |
| 6,926,581 | B2 | 8/2005 | Lynders et al. | |
| 6,966,807 | B2 | 11/2005 | Leonov et al. | |
| 7,033,241 | B2 | 4/2006 | Lee et al. | |
| 2002/0148664 | A1 | 10/2002 | Hanagan et al. | |
| 2003/0077979 | A1 | 4/2003 | Hoeting et al. | |
| 2004/0035624 | A1 | 2/2004 | Fecteau et al. | |
| 2006/0009119 | A1 * | 1/2006 | Hoeting et al. | 446/440 |
| 2006/0086555 | A1 | 4/2006 | Dower | |
| 2008/0220692 | A1 | 9/2008 | Torres et al. | |
| 2009/0098799 | A1 | 4/2009 | Leonov et al. | |

FOREIGN PATENT DOCUMENTS

| | | | |
|---|---|---|---|
| FR | 2846623 | A1 | 5/2004 |
| GB | 2328621 | A | 3/1999 |
| GB | 2382334 | A | 5/2003 |
| JP | 2004166720 | A | 6/2004 |
| WO | WO-8702951 | A1 | 5/1987 |
| WO | 2004011324 | A1 | 2/2004 |

OTHER PUBLICATIONS

Int'l Preliminary Report on Patentability issued Jul. 2, 2009 in Int'l Application No. PCT/US07/83000.

Office Action issued Oct. 8, 2010 in CN Application No. 200780046485.6.

Office Action issued Jan. 9, 2012 in MX Application No. MX/a/2009/006715.

EP Search Report issued on Dec. 23, 2011 in EP Application No. 07 863 655-2-2318.

* cited by examiner

THREE WHEELED TOY VEHICLE

CROSS-REFERENCE TO RELATED APPLICATIONS

The present application is a continuation of PCT/US2007/083000 filed Oct. 30, 2007, entitled "Three Wheeled Toy Vehicle" and claims priority from of U.S. Provisional Patent Application No. 60/870,748 filed Dec. 19, 2006 and entitled Toy Vehicle Controller; and U.S. Provisional Patent Application No. 60/953,636 filed Aug. 2, 2007, entitled Toy Vehicle Controller, the entire subject matters of which are hereby incorporated herein by reference.

BACKGROUND OF THE INVENTION

Toy vehicles are well known. It is believed that a new toy vehicle providing features and performance of heretofore unavailable motion would provide more engaging play activity than already known vehicles.

SUMMARY OF THE INVENTION

Briefly, the invention is a motorized toy vehicle comprising: a chassis with opposing, top and bottom sides and opposing, first and second longitudinal ends and a central plane extending in a vertical direction and a longitudinal direction through the chassis and at least generally bisecting the sides and ends; first and second wheels coupled with the chassis proximal the first end so as to pivot with respect to the chassis and steer the first end, the first and second wheels being located on opposite sides of the central plane; a third wheel coupled with the chassis proximal the second end so as to span the central plane and pivot with respect to the chassis at least at an axis located in and parallel to the central plane, pitched at an angle between vertical and longitudinal directions; and a steering coupling operably connecting the first and second wheels with the third wheel to simultaneously pivot the first, second and third wheels with respect to the chassis so as to steer the toy vehicle at the first and second ends of the chassis to turn the toy vehicle in a selected direction.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
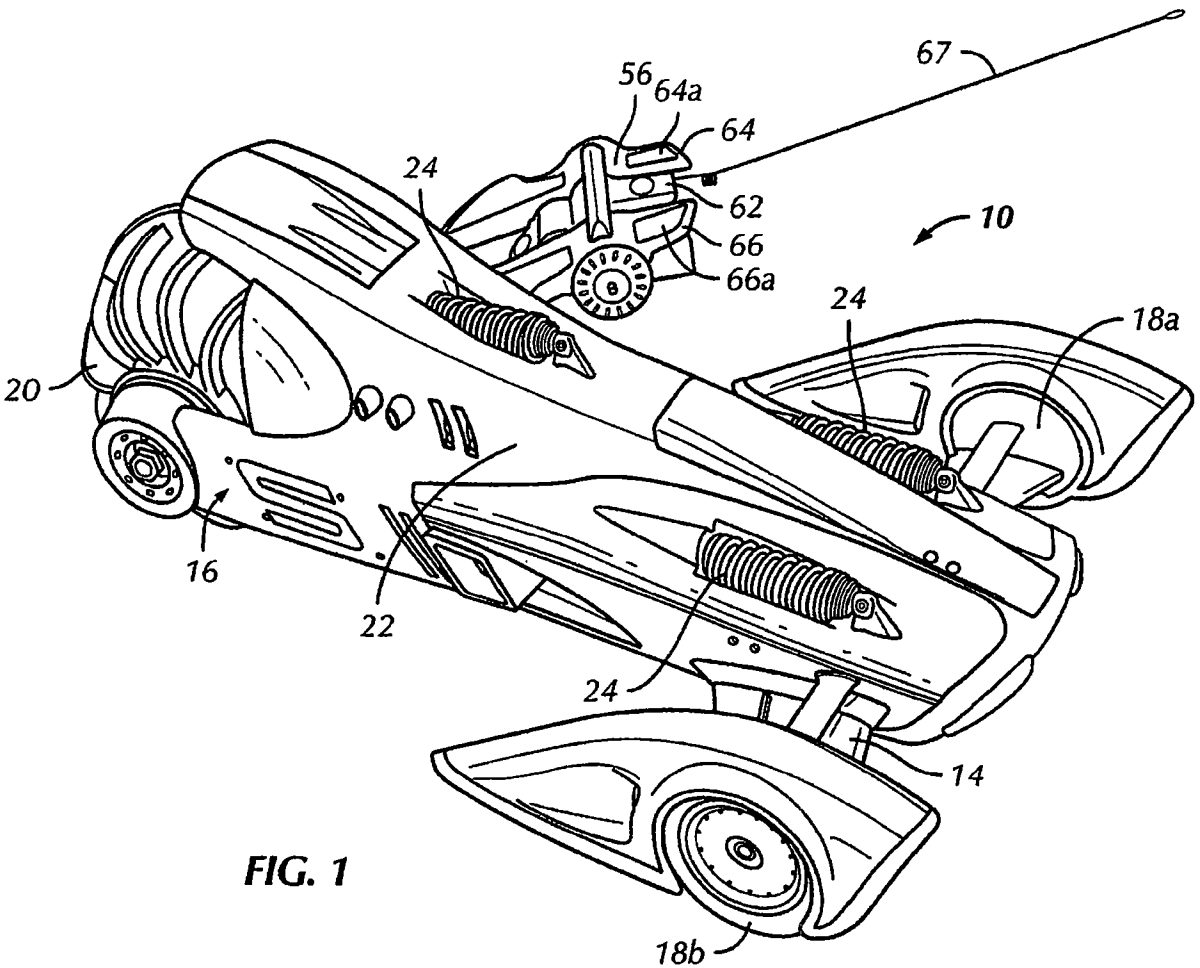
FIG. 1 is an upper front perspective view of the right side of a toy vehicle in accordance with a first preferred embodiment of the present invention.

Certain terminology is used in the following description for convenience only and is not limiting. The words "right", "left", "front", "rear", "upper" and "lower" designate directions in the drawings to which reference is made. The terminology includes the words above specifically mentioned, derivatives thereof, and words of similar import.

Referring to the photographs in detail, wherein like numerals indicate like elements throughout, there is shown in FIGS. 1-11 a presently preferred first embodiment of a three wheeled toy vehicle (or simply "toy vehicle") generally designated at 10. The toy vehicle 10 is configured for use on land or in water.

Figure 2:
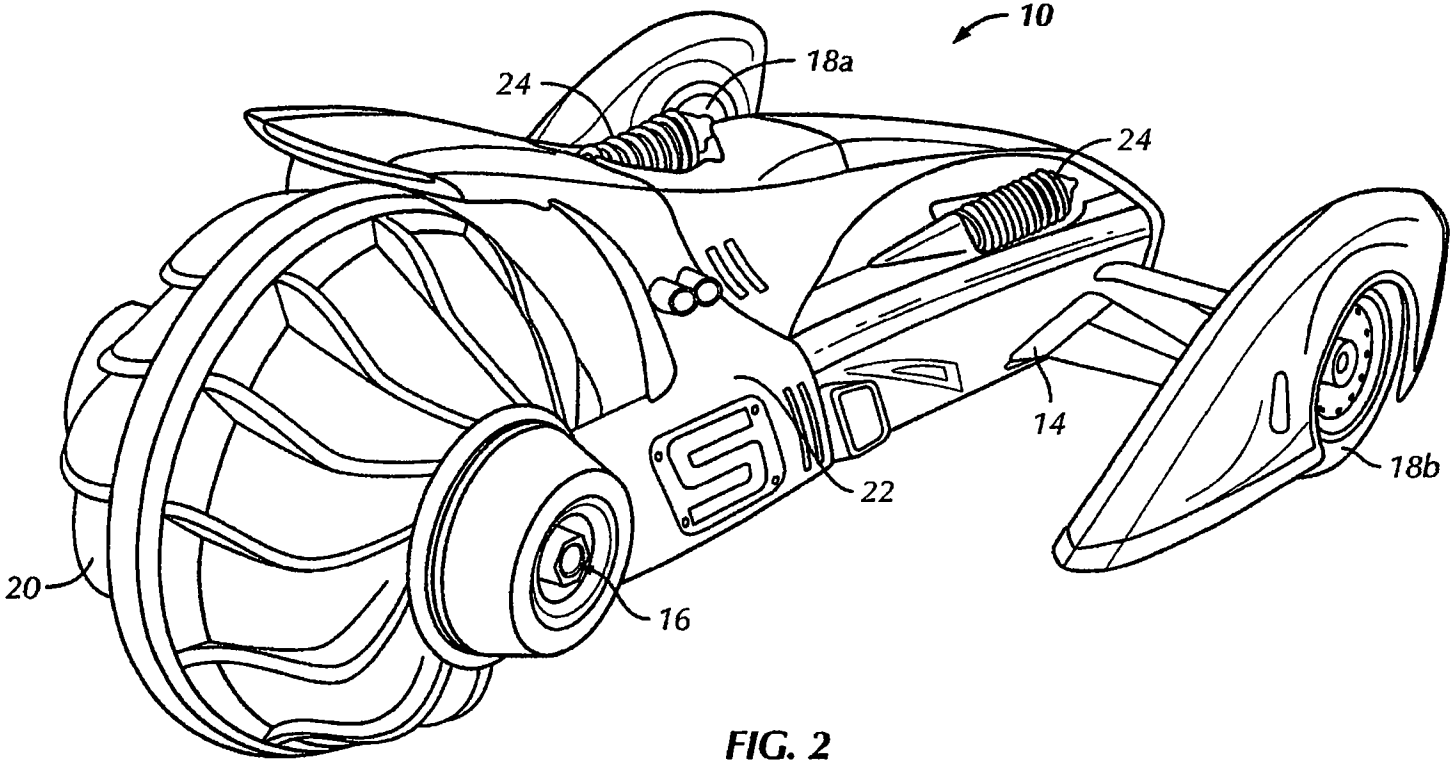
FIG. 2 is an rear perspective view of the right side of the toy vehicle of FIG. 1.
Figure 3:
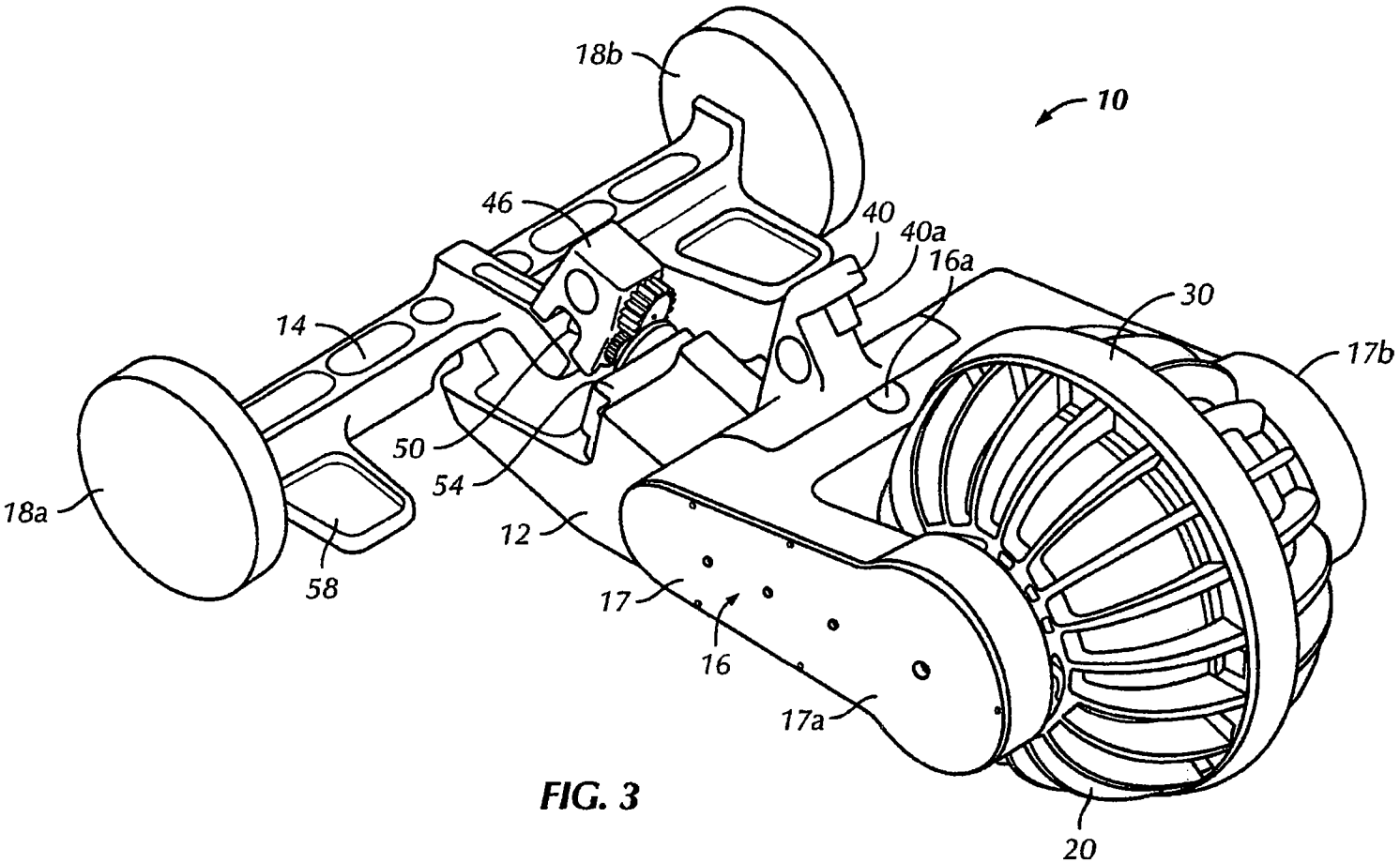
FIG. 3 is a rear perspective view of the left side of the toy vehicle of FIG. 1 with the protective body removed.

With initial reference to FIGS. 1-3, a motorized toy vehicle 10 includes a chassis 12 with opposing major (top and bottom) sides 13*a*; 13*b* and opposing longitudinal first and second/front and rear ends 13*c*, 13*d*. Coupled with the chassis 12 are a front suspension 14 and a rear suspension 16, and preferably three wheels. A central plane 12*a* extends longitudinally between and through the front and rear ends 13*c*, 13*d* and vertically between and through the top and bottom sides 13*a*, 13*b*, generally bisecting the ends 13*c*, 13*d* and the sides 13*a*, 13*b*. The wheels include a pair of steerable front wheels 18 (first and second wheels individually denoted at 18*a*, 18*b*) coupled with the chassis 12 proximal the first (front) end 13*c* so as to pivot with respect to the chassis 12 and steer the toy vehicle 10. First and second wheels 18*a*, 18*b* are located on opposite sides of the central plane 12*a*. The vehicle 10 includes a third wheel 20 coupled with the chassis 12 proximal the second (rear) end 13*d* so as to span the central plane 12*a*. The chassis 12 and front and rear suspensions 14, 16, support a decorative and protective body 22. The protective body 22 may include any shape, size or configuration that allows the toy vehicle 10 to move as described below and is not limited to the embodiments shown in FIGS. 1-2 and 10-11. Shocks 24 are shown as nonfunctional decorative additions to the protective body 22 but may be coupled to the front suspension 14 or a front bumper (not shown).

Figure 4:
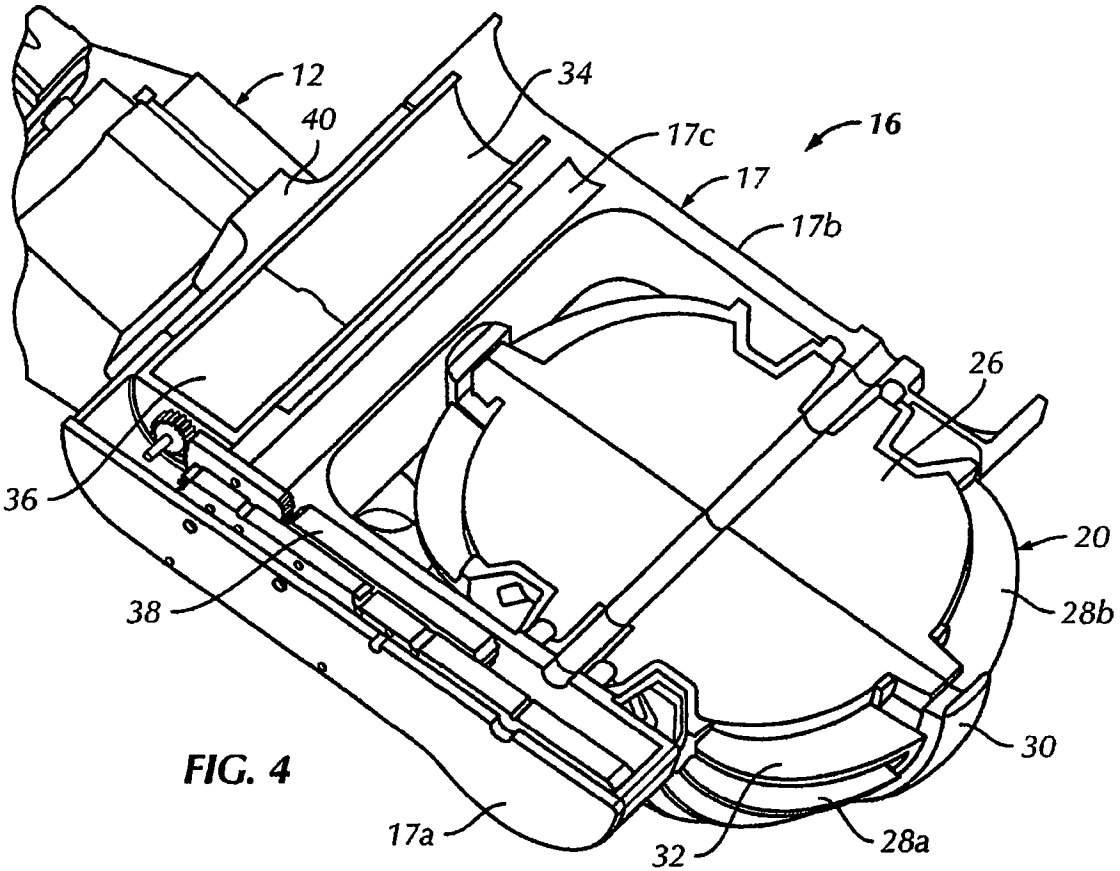
FIG. 4 is a partial top, rear, left-side cross sectional perspective view of the rear tire and rear suspension of the toy vehicle of FIG. 1.
Figure 5:
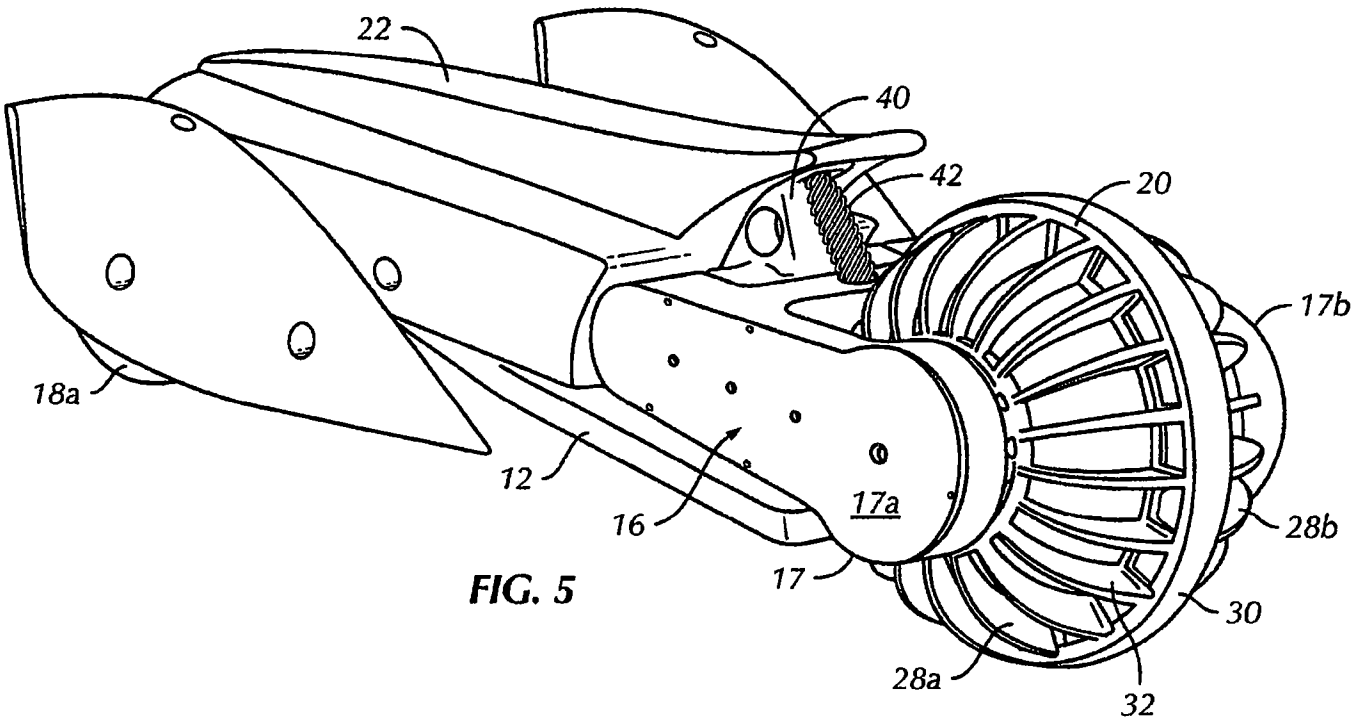
FIG. 5 is a rear perspective view of the left side of the toy vehicle of FIG. 1 sectioned generally along the central plane of the toy vehicle showing chassis with an alternate protective body and an exposed rear suspension.

Referring to FIGS. 4 and 5, propulsion of the toy vehicle 10 is preferably provided through the third wheel 20 which is the only rear wheel. The rear third wheel 20 is comprised of an inner core 26, left and right paddles 28*a* and 28*b*, and an elastomeric ring 30. Preferably, the inner core 26 is comprised of any material capable of absorbing impacts to the third wheel 20 as well as being buoyant in water. The inner core 26 maybe expanded polypropylene, foam, or air. Left and right paddles 28*a*, 28*b* surround the inner core 26. Preferably, the paddles 28 are comprised of a flexible elastomeric material. A plurality equally spaced vanes 32 are be provided around both lateral sides of the left and right paddles 28*a*, 28*b*, extending outwardly from the paddles 28, to assist in propulsion of the toy vehicle 10 in the water. The vanes 32 are preferably curved and tapered toward the center of the third wheel 20 to provide a tubular shape to the third wheel 20. The vanes 32 are shown as being straight in the radial direction but may also have a tangential curve to further assist in steering and propelling the toy vehicle 10. The ring 30 is positioned circumferentially around the center of the third wheel 20 at the point where the left and right paddles 28*a*, 28*b* are joined. The ring 30 extends radially farther than the paddles 28 from the center of the third wheel 20 such that the ring 30 contacts the land surface when on land and prevents the paddles 28 from touching the land surface. However, the vanes 32 may touch the land surface when the third wheel 20 is pivoted (as will be described) and they function as tire treads. The third wheel 20 is rotatably mounted to and driven through the rear suspension 16. The third wheel 20 may be driven similarly to the rear wheel in U.S. Pat. No. 6,854,547 B2, issued Feb. 15, 2005, and incorporated by reference in its entirety.

Figure 6:
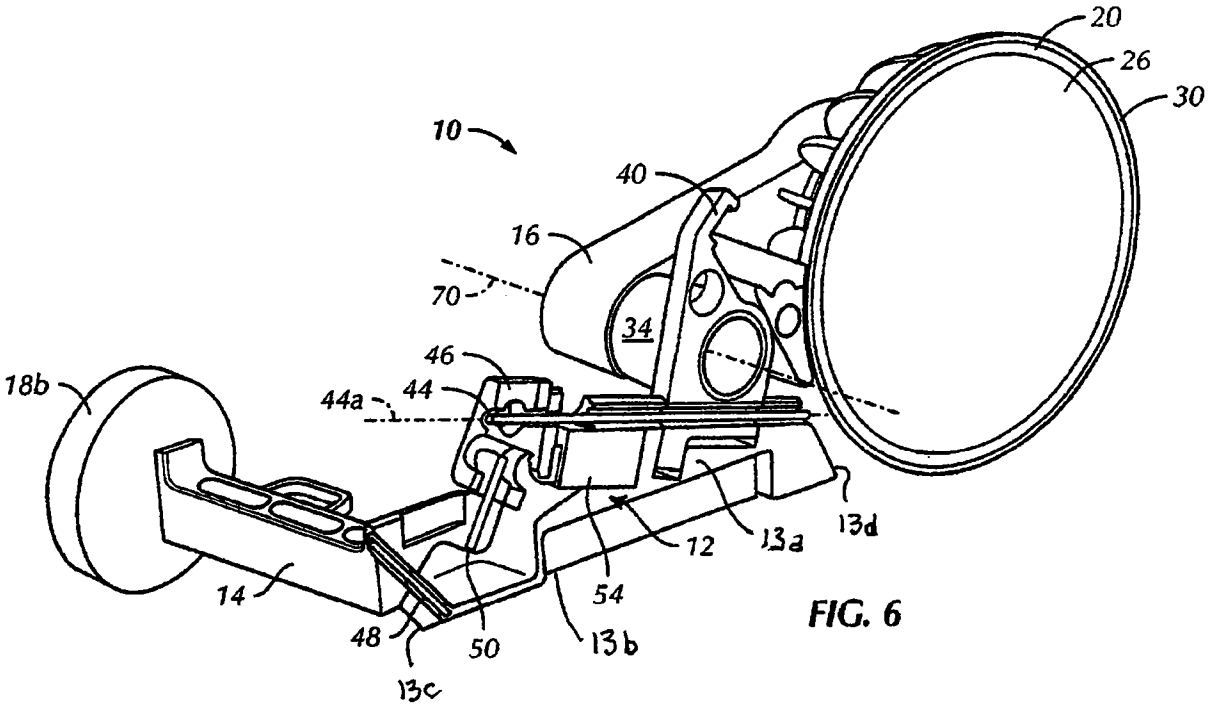
FIG. 6 is a front left cross sectional perspective view of the right side section of the chassis of the toy vehicle of FIG. 1 shown in FIG. 3.
Figure 10:
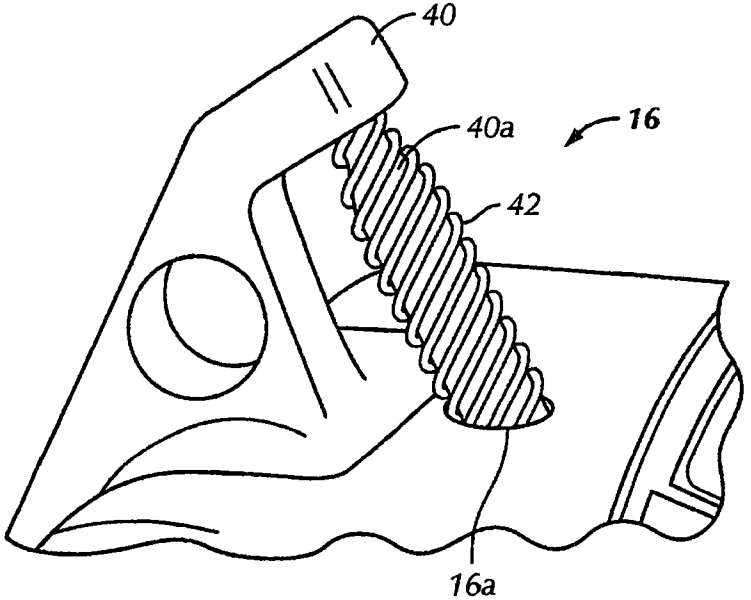
FIG. 10 is an upper rear perspective view of the left side of the rear suspension support of the toy vehicle of FIG. 1.

Referring to FIGS. 5, 6 and 10, the rear suspension 16 is preferably includes a U-shaped frame or similar structure, which is pivotably attached to the central chassis 12 to allow vertical movement of the rear suspension 16 with respect to the chassis 12 about a generally horizontal rear wheel pivot axis 70 generally extending perpendicularly to the central plane 12*a* and displaced from the rotational axis of the third wheel 20. Preferably, the rear suspension 16 includes a hollow housing 34 that contains an internally mounted, preferably reversible electric motor 36. A gear train 38 can be provided to gear down the output of the motor 36. However, the third wheel 20 may also be driven by any suitable means such one or more flexible members with pulleys or sprockets or a combination thereof or even an external friction wheel or gear on/in the rear suspension 16 driven along the circumferential outer surface of the third wheel 20. The rear suspension 16 preferably includes a suspension arm 40. The suspension arm 40 pivotably supports and surrounds the hollow housing 34, motor 36, and a pivot axis 70 of the frame 17. The suspension arm 40 maybe connected to frame 17 by a rear shock assembly 42. The suspension arm 40 and the rear shock assembly 42 provide a rear damper and downward spring bias to the frame 17 with respect to the central chassis 12. The rear shock assembly 42 may be as simple as a coil spring extending between a pin 40*a* on the extension arm 40 and a bore 16*a* in cross member 17*c* of frame 17. The rear shock assembly 42 may also be concealed by extending the assembly 42 farther into the rear suspension 16. Also, the shock 42 could be replaced by a torsion spring in or on the hollow housing 34 or elsewhere between the frame 17 and the suspension arm 40.

Referring to FIGS. 6-9, a rear pivot shaft 44 preferably supports the suspension arm 40 with the rear wheel 20 and rear suspension 16 to pivot with respect to the chassis 12 along and specifically at a pivot axis 44*a*. Axis 44*a* is coplanar with and lies in the central plane 12*a*, but is pitched away from the vertical direction of the plane 12*a* and toward the longitudinal direction, preferably in a nearly horizontal or longitudinal direction of the plane 12*a* so as to effectively provide a roll axis for the rear suspension 16 and rear wheel 20. The suspension arm 40 is nonrotatably attached to the rear pivot shaft 44. The shaft 44 is broken away in FIGS. 6 and 9 for clarity of other elements. The rear pivot shaft 44 is rotatable with respect to the chassis 12 and is to be driven by a steering servo 54, preferably operably coupled with the steering servo 54 through pinion 72 and gear 74 fixed to shaft 44 and meshed with the pinion 72. A link 46 is nonrotatably attached to the front end of the rear pivot shaft 44 most proximal the front suspension 14 and operably connects the rear pivot shaft 44 with the front suspension 14. The front suspension 14 is preferably connected to the central chassis 12 through a front pivot shaft 48 for rotation about pivot axis 48*a* central to shaft 48. A pin 50 preferably extends up from the front suspension 14 into the link 46. The link 46 preferably includes two pin bars 52 generally parallel to the rear pivot shaft 44 and spaced apart from one another. The free end of the pin 50 is inserted into the link 46 and between the pin bars 52. The pin 50 and link 46 may also be replaced with another rotary coupling such as a crank (not shown) rather than the pin 50 and link 46 to provide for the same offset rotary motion as described below.

A control circuit 100 (FIG. 13) directs each of the motor 36 and the steering servo 54. To propel the toy vehicle 10, the motor 36 is activated. To steer the toy vehicle 10, the steering servo 54 is activated. The steering servo 54, which is suggestedly is provided with a 2 to 1 gear reduction, rotates the rear pivot shaft 44 up to about 30 degrees in either direction from a central or neutral, straight ahead position of the three wheels 18, 20. When the rear pivot shaft 44 is pivoted, the suspension arm 40 and yoke 17 of the rear suspension 16 and the third wheel 20 are all rotated (i.e. rolled) about the axis of rotation 44*a* of the rear pivot shaft 44 thereby pivoting such that the top and bottom of third wheel 20 tilt in the opposite direction towards either the left or right side of the toy vehicle 10. The rear pivot shaft 44 is positioned at an angle sufficiently canted such that the axis of rotation of third wheel 20 is also tilted at a non-zero angle with respect to the longitudinal, (i.e. horizontal) direction and thereby causes the toy vehicle 10 to turn when in motion. Axis 44*a* is tilted between the vertical and longitudinal directions so that when the front suspension pivots on axis 44*a*, the suspension 14 (and the front wheels 18) also effectively roll about an imaginary longitudinal axis so as to keep all three wheels 18, 20 level. Tilting of the third wheel 20 also helps to favor submersion of either the left or right paddle 28*a* or 28*b* allowing the toy vehicle 10 to turn in water. As the rear pivot shaft 44 moves, the link 46 also pivots the front suspension 14 and wheels 18 with respect to the chassis 12. As the link 46 pivots, one of the two link bars 52 urges the pin 50 in the direction of the link 46 on rotating pivot shaft 44. Movement of the pin 50 causes the front suspension 14 to rotate about the front suspension shaft 48 causing the toy vehicle 10 to turn when in motion. This movement of the front suspension 14 pivots the pair of front wheels 18 with respect to the chassis 12 and steer the front end 12*c*. This coupling causes the top of third wheel 20 to tilt to the side corresponding to the pivoted direction of the front wheels 18 allowing for improved turning capabilities in water and a smaller turning radius overall on land as well as water as the front wheels 18 also acts as steering fins or rudders on water.

Figure 7:
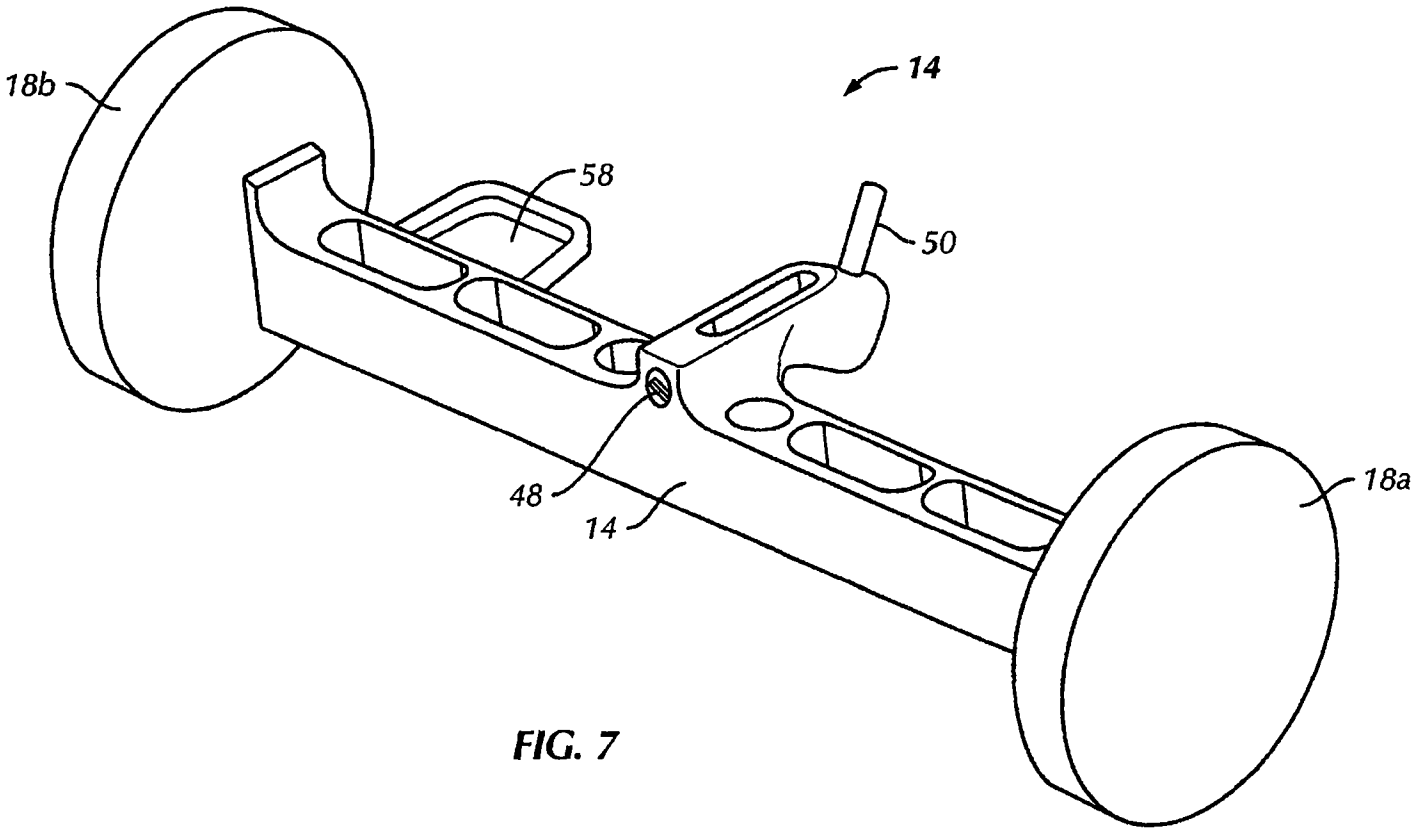
FIG. 7 is an upper front perspective view of the front suspension of the toy vehicle of FIG. 1.
Figure 8:
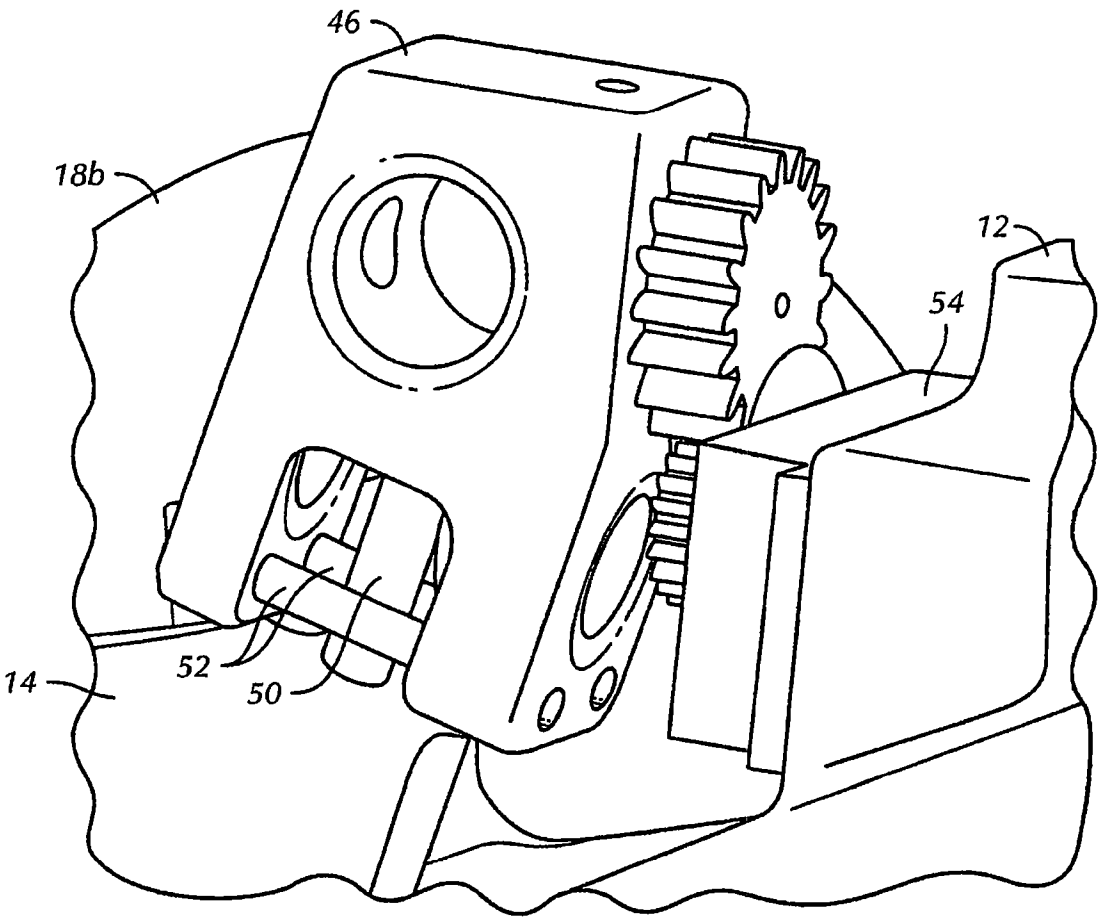
FIG. 8 is a side perspective view of the suspension coupler of the toy vehicle of FIG. 1.
Figure 9:
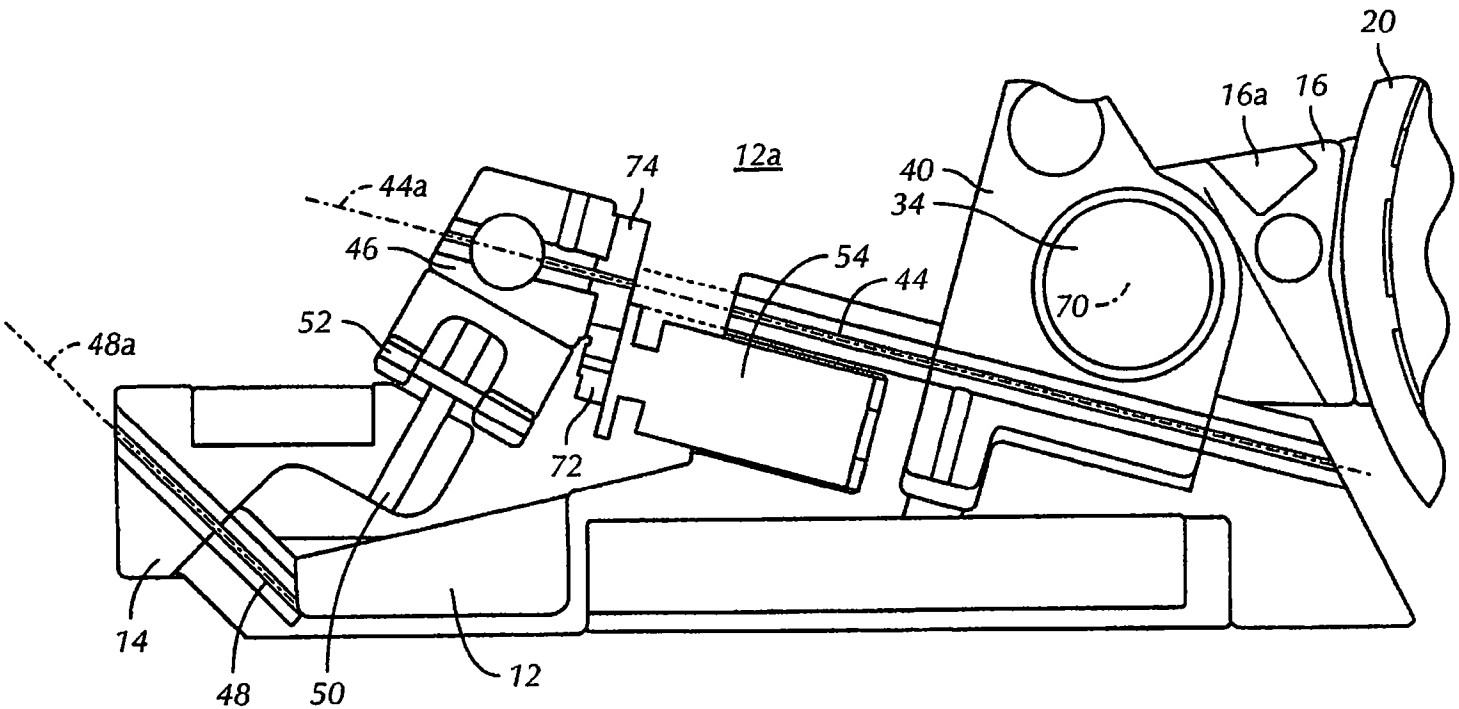
FIG. 9 is a side section view of the chassis and front and rear suspension of the toy vehicle of FIG. 1 taken along the central longitudinal/vertical plane of the chassis, bisecting the chassis and rear wheel.
Figure 11:
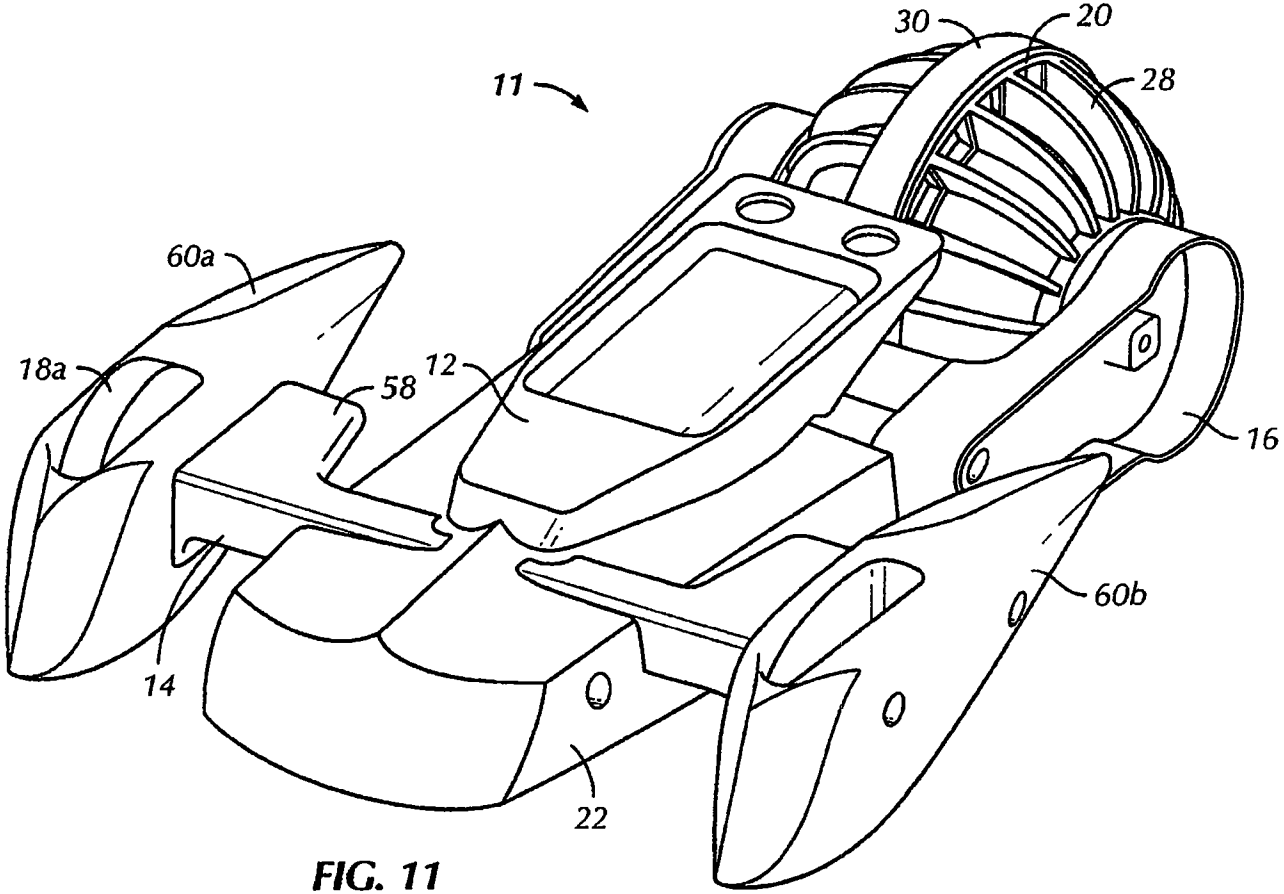
FIG. 11 a bottom front perspective of the right side of the toy vehicle of FIG. 1 as shown in FIG. 5.

Referring to FIGS. 7 and 11, the front wheels 18 are preferably hollow and sealed against fluid leakage to make the front end of vehicle 10 buoyant and amphibious. Flotation, such as a buoyant material or air pockets may also be positioned on tabs 58 (See FIGS. 3 and 7), in the frame 17 of rear suspension 16 and/or under the chassis 12. Preferably, the toy vehicle 10 is at least sufficiently buoyant so as to submerge less than half of the third wheel 20. Left and right pontoons 60*a* and 60*b* preferably may be positioned over the front wheels 18*a* and 18*b* respectively to provide even more buoyancy and stability and even act as steering fins in the water. Moving the buoyant material out towards the front wheel 18 also allows the protective body 22 to be a sufficiently hollow to provide unrestricted rotation with the rear suspension 16.

Figure 13:
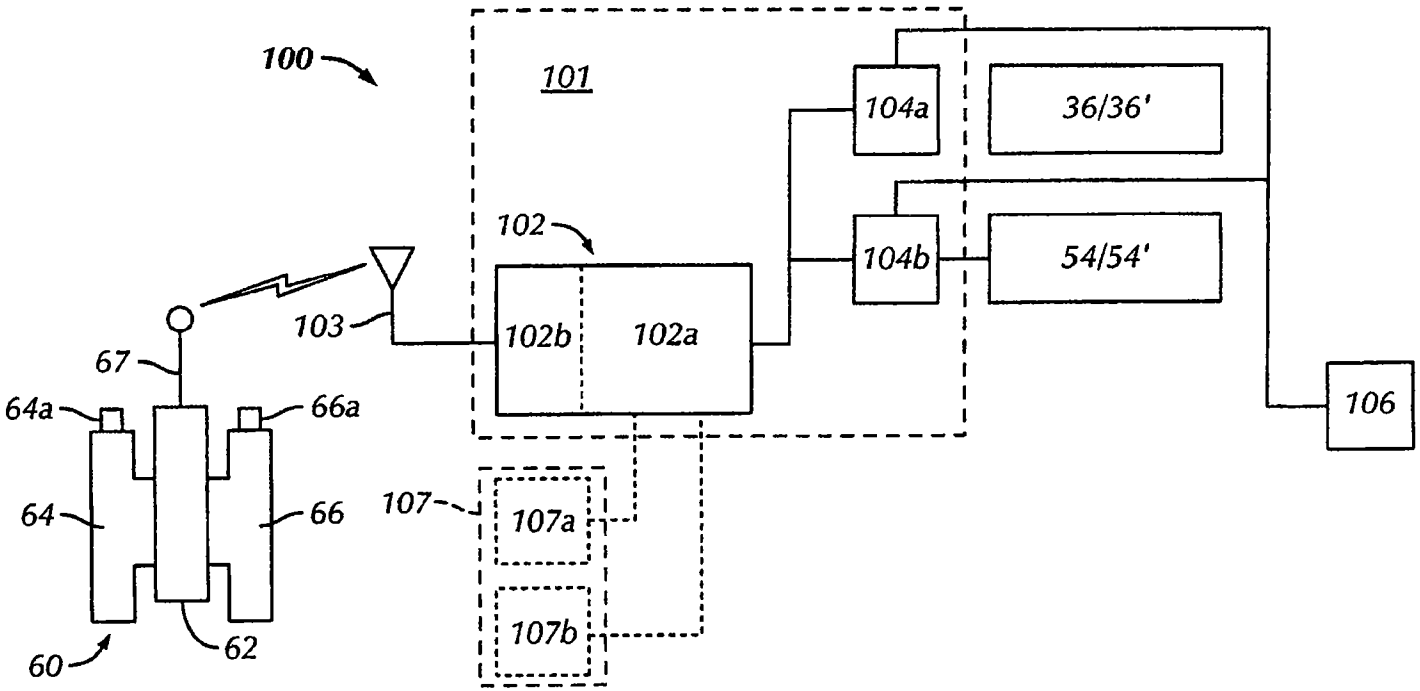
FIG. 13 is a block diagram of the circuitry of the toy vehicles.

The steering servo 54 and the motor 36 are conventionally powered by an on-board power source or supply 106 (FIG. 13), such as a battery or battery pack. Furthermore, it is preferred that the toy vehicle 10 have conventional remote control elements, for example, mounted on a circuit board 101. Referring to FIG. 13, a conventional radio receiver 102, microprocessor 102*b* can be combined in a central circuit a 102 and used to control central appropriate motor control subcircuits 104(*a*), 104(*b*) to be remotely controlled by a user using a generally conventional remote control device or transmitter 60 spaced from the toy vehicle device 10. While remote control of the toy vehicle 10 is preferred, it will be appreciated that the toy vehicle can be factory preprogrammed to perform a predetermined movement or series of movements or can be configured to be selectively programmed by a user to create such predetermined movement(s). Alternatively or in addition, the toy vehicle 10 can be equipped with sensors, e.g., switches, proximity detectors, etc., that will control the toy vehicle 10 to turn away from or reverse itself automatically from whatever direction it was moving if or when an obstacle is contacted or otherwise sensed.

Figure 12:
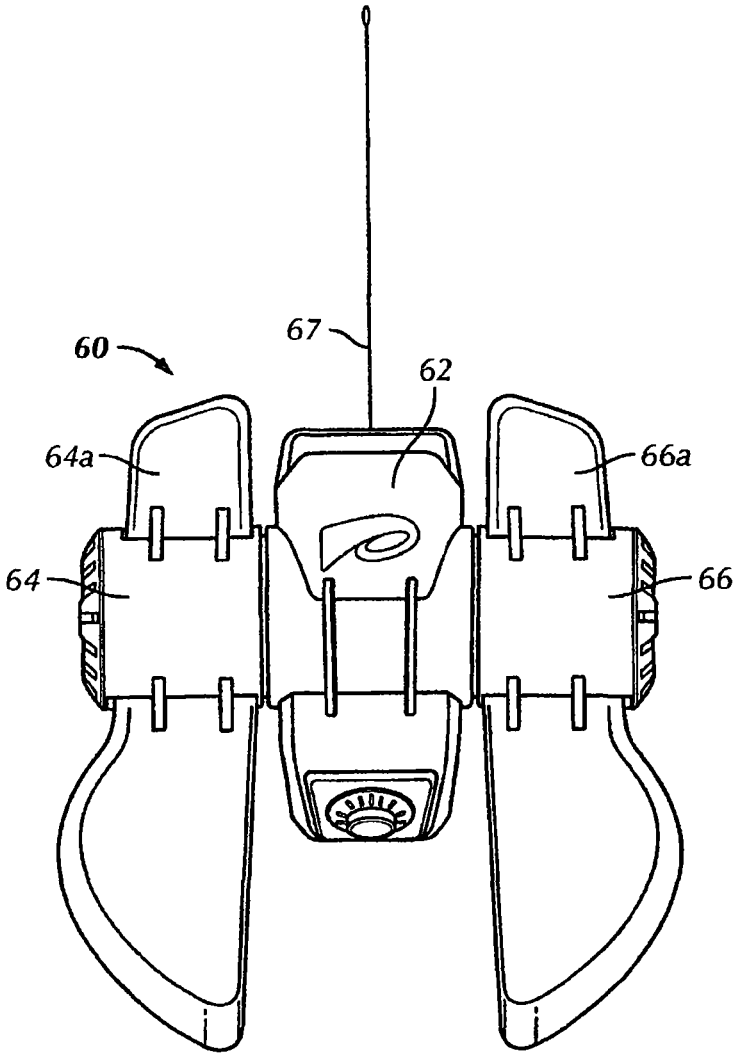
FIG. 12 is front top perspective sketch of the right side of a controller shown in FIG. 1 and used in accordance with the toy vehicle of FIG. 1.

Referring to FIGS. 1, 12 and 13, a preferred remote control or transmitter 60 may be comprised of a three piece housing having a central hub 62 a left arm 64 and a right arm 66. The left and right arms 64, 66 can be independently pivotably connected to either side of the central hub 62, or more preferably, central hub 62 and one arm (e.g. right arm 66) are fixedly connected together and the other arm (e.g. left arm 64) is rotatably attached to the pair 62/66. The central hub 62 houses the electronics (not shown), which are themselves conventional, and relative motion of left arm 64 and right arm 66 from a neutral position, as seen in FIGS. 1 and 12, steers the toy vehicle 10. An antenna 67, as shown in FIGS. 1 and 12, extends from the central hub 62 for emitting a radio frequency. Arm pads 64*a*, 66*a*, as shown in FIG. 1, may be positioned on the top side of the remote control 60 for forward and backward movement. Triggers (not shown in Figs.) may be positioned on the bottom side of the left arm 64 and the right arm 65 opposite pads 64*a*, 66*a* shown on the top side of the remote control 60 and may be compressed or released to control other features, if provided.

Figure 14:
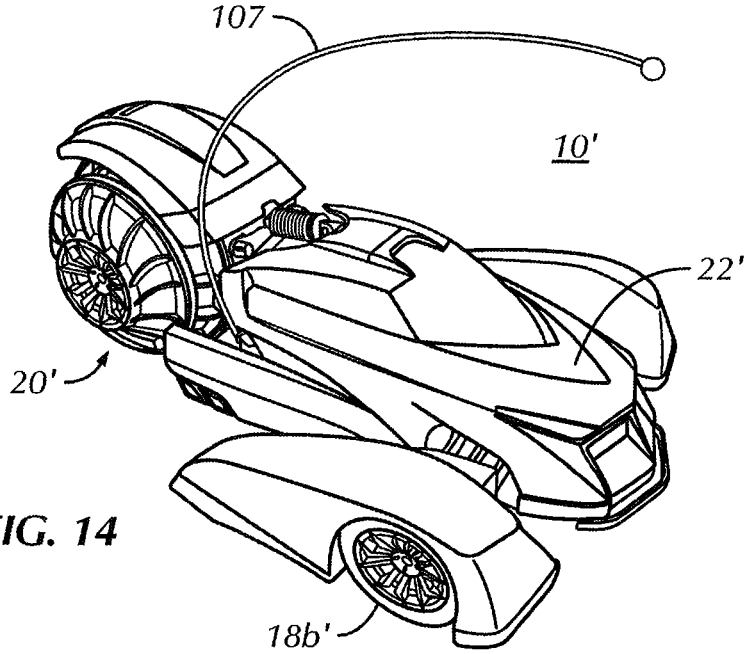
FIG. 14 is a perspective view of the top, front and left side of a toy vehicle in accordance with a second preferred embodiment of the present invention.
Figure 15:
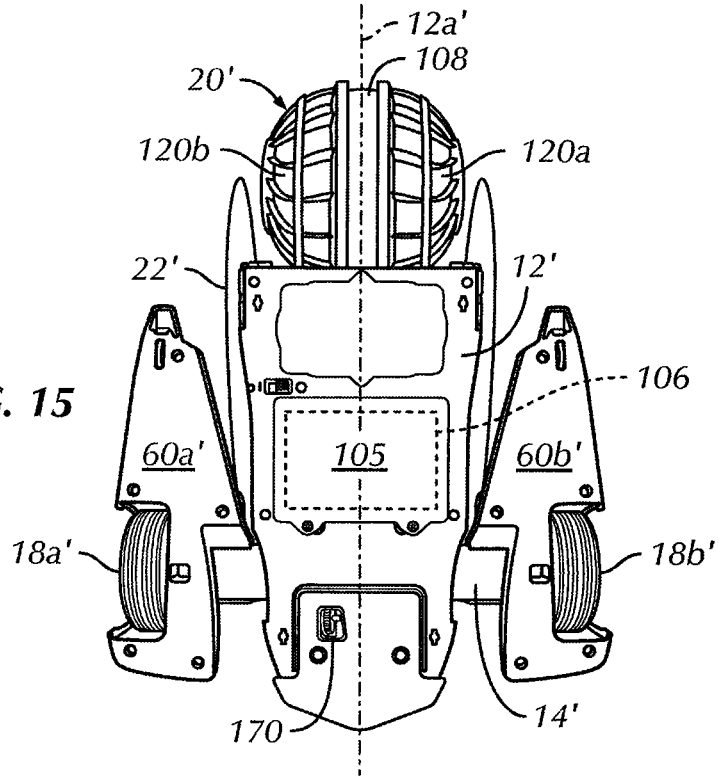
FIG. 15 is a bottom perspective view of the toy vehicle of FIG. 14.
Figure 16:
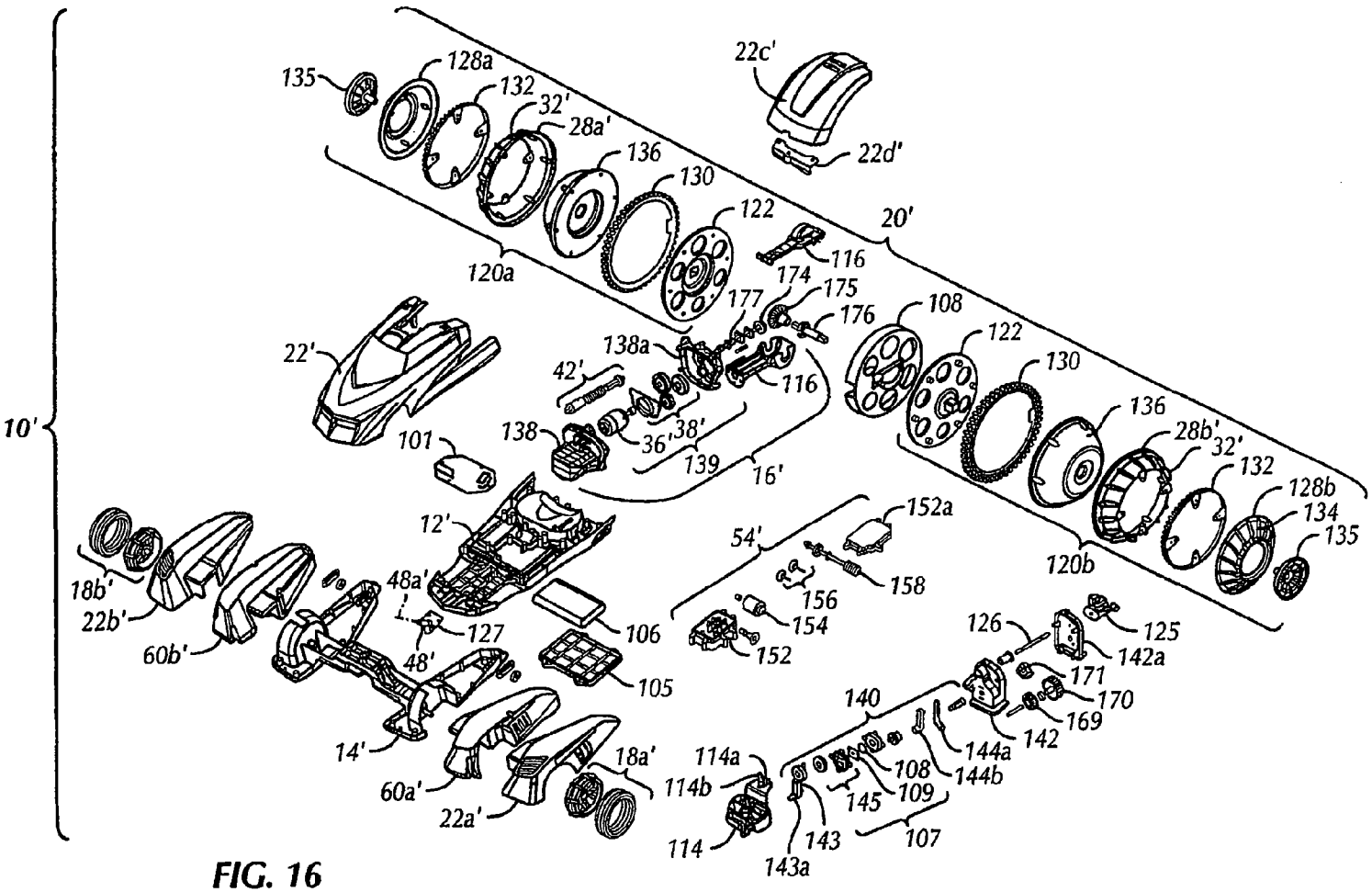
FIG. 16 is an exploded upper front perspective view of the toy vehicle of FIG. 14.

Referring to FIGS. 14-16, a second preferred embodiment of the motorized toy vehicle indicated generally at 10' is shown, including like reference numerals to indicate like elements and a prime symbol (') distinguishing the reference numerals of the second preferred embodiment from the first preferred embodiment where differences are noted or apparent. The second preferred embodiment toy vehicle 10' is substantially similar to the first preferred embodiment toy vehicle 10. The second preferred embodiment of the toy vehicle 10' is three wheeled and is configured for use on land or in water. The toy vehicle 10' of also includes a chassis 12' operably coupled with a front suspension 14' and a rear suspension 16', and three wheels 18*a*', 18*b*', 20' for steering and propulsion. A differently styled body 22' sits on chassis 12'. However, as seen in FIG. 16, the rear wheel 20' and power train of the second toy vehicle 10' differ from functionally those of the toy vehicle 10 of the first preferred embodiment.

Referring to FIG. 16, preferably a hinge 125 supports the rear suspension 16' and the single rear wheel 20' from the chassis 12' and allows the rear suspension 16' and the single rear wheel 20' to pitch (i.e. move in a vertical direction about a transverse, horizontal axis) and generally roll (i.e. turn on an axis running substantially longitudinally through the vehicle 10') with respect to the chassis 12'. Preferably, drive motor 36' and a train of reduction gears 38' form a drive train 139 which is supported in a drive train housing 138, which is itself pivotally supported from the hinge 125 to pitch up and down with respect to the hinge 125. A cover 138*a* encloses the drive train 139 within the drive train housing 138. Preferably a shock assembly 42' is operatively connected between the hinge 125 and a top portion of the drive train housing 138 or housing of rear suspension 16' to absorb excess or unwanted vertical motion of the rear suspension 16' and rear wheel 20'. Hinge 125 further permits drive train 139, rear suspension 16' and the rear wheel 20' to drop with respect to chassis 12' as those components are rolled for steering in a manner which will now be described.

Second toy vehicle 10' is again preferably steered through a servo 54'. More particularly, for example, a rear end of a rotation shaft 126 is fixedly engaged with a front portion of the hinge 125 to support and roll the hinge 125 with the drive train 139, housing 138, rear suspension 16' and wheel 20' with respect to the central chassis 12' about a central axis of shaft 126, which is preferably co-planar with a central longitudinal and vertical plane 12*a*' of the toy vehicle 10. Preferably, the rotation shaft 126 passes through a servo output mechanism indicated generally at 140, which is itself driven by a servo 54'. Preferably, rotation shaft 126 is supported for driven rotation in a housing 142 with cover 142*a*. Housing 142 is fixedly mounted on top of the chassis 12' with servo 54' so as to be powered by the servo 54'. Preferably, servo 54' powers output mechanism 140 though a screw 158 driven by a motor 154 located with a reduction gear train 156 in a housing 152 with cover 152*a*. Preferably, screw 158 drives a reduction "steering" gear 169 which, in turn, drives a sector or partial gear 171 fixed to the rotation shaft 126 in housing 142 to rotate the shaft 126. Preferably a manually operated, steering adjustment wheel 170 is provided, connected and preferably clutched to gear 169 to manually center the front and rear wheels 18, 20 and front and rear suspensions 14, 16 in a neutral, straight ahead orientation.

In addition or in the alternative, a front portion of the rotation shaft 126 preferably is operatively connected to the front suspension 14' to pivot the front wheels 18*a*' 18*b*' at the same time it rolls the rear suspension 16' and wheel 20' side to side in order to steer the toy vehicle 10' in a selected direction. The rotation shaft 126 thus is a steering coupling which operably couples and connects the front and rear suspension 14, 16 and wheels 18, 20. Preferably a shaft 48' is fixedly mounted to a front portion of the central chassis 12' by a bracket 127 to provide a pivot point at which the front suspension 14' may rotate with respect to the central chassis 12'. A crank 143 is operably connected to the front end of rotation shaft 126 preferably through a clutch 145. Preferably, pin 143*a* on the distal end of crank 143 is operatively engaged with the steering retainer 114 which is fixedly engaged to the front suspension 14'. Specifically, pin 143*a* is located between two posts 114*a*, 114*b* that orthogonally extend from the top of steering retainer 114. When the crank 143 is caused to pivot or rotate as a result of rotation of the rotation shaft 126, the pin 143*a* presses against one of the posts 114*a*, 114*b* of the steering retainer 114 to cause the steering retainer 114, and thus the front suspension 14' with front wheels 18*a*', 18*b*' to pivot about an at least partially vertical axis such that the toy vehicle 10' may be steered through the front wheels 18*a*', 18*b*'. Thus, the front suspension 14' is rotated with the pair of front wheels 18*a*', 18*b*' on the shaft 48' on bracket 127 with respect to the central chassis 12'. Like shaft 48, shaft 48' is pitch forward so that the front suspension 14' tilts (rolls) as it pivots (yaws) on shaft 48'. In the preferred steering configuration disclosed in vehicle 10', the two front wheels 18*a*', 18*b*' of the toy vehicle 10' are mounted to the front suspension to remain coaxial and are turned (yawed) and pitched (rolled) by rotating and pitching the front suspension 14', while the rear suspension 16' and wheel 20' are simultaneously rolled to one side by the servo 54', which is operably connected to each suspension 14', 16' and all of the wheels 18', 20' through the servo output mechanism 140 and rotation shaft 126, to steer the toy vehicle 10' at both ends of the toy vehicle 10' through the three wheels 18', 20' to turn the toy vehicle in a selected direction.

The degree of rotation of the rotation shaft 126 can be controlled in various ways. Referring also to FIGS. 13 and 16, preferably, the front end of rotation arm 126 is operably connected with an angular encoder 107 which may be of any suitable configuration to output one or more signals to on-board control circuitry 100. For example, the rotation shaft 126 can carry one or more cams (not depicted) for closing switches or one or more electrical contacts or "wipers" 108 through which current can be passed to a set of stationary contacts, for example, on a smaller board 109 in encoder 107. In addition, if desired, a pair of trim adjustment levers (one on the housing 140 and one on the shaft 126) can be provided to manually center the shaft 126 into a neutral (straight forward/backward) direction in addition to or in place of adjustment wheel 170.

A drive motor 36' and reduction gear train 38' power the rear wheel 20'. Preferably, the motor 36' is operatively connected to a front portion of a drive shaft 177 and rotates or drives the drive shaft 177 through reduction gear train 38'. The drive shaft 177 is operatively positioned within the rear suspension 16' and preferably extends from the last gear in train 38' through the cover 138*a* from the gear train 38' into a rear suspension housing 116 and into the rear wheel 20'. Rotation of drive shaft 177 extending longitudinally through vehicle 10' is transferred to a power shaft 176 extending transversely though the rear wheel 20' and housing 116. Drive shaft 177 is operably connected with power shaft 176 through a suitable coupling, for example a bevel gear 174 is located on a rear end of the drive shaft 177 meshing with a bevel gear 175 operatively connected to a power shaft 176 to transfer power or rotational motion from the motor 36' to the rear wheel 20'.

Rear/third wheel 20' may be of any suitable construction but preferably is an assembly comprising a pair of half wheel assemblies rotatably mounted to a stationary cover ring or central hub 180, which is part of and fixedly attached to the rear suspension housing 116. As depicted, the half wheel assemblies are located on opposite side of hub 180 and are fixedly coupled together so as to be supported for rotation together on the hub. As further depicted, the hub 180 is centered in the central vertical plane and in the third wheel 20' and is stationary in the third wheel 20'. As still further depicted, the each of the half wheel assemblies is in the form of a truncated hemisphere having a maximum diameter located proximal the hub 180 and a truncation with lesser diameter (perpendicular to the rotation axis of the third wheel 20') located distal to the hub 180. The power shaft 176 extends axially through a central opening in the cover ring/central hub 180 to operatively connect with identical left and right rotation rings 122 of the rear wheel 20'. Each end of the power shaft 176 is keyed into a central portion of each rotation ring 122 such that each rotation ring 122 rotates with rotation of the power shaft 176 to provide power to the rear wheel 20'. Similar to the toy vehicle 10 of the first preferred embodiment, the toy vehicle 10' of the second preferred embodiment includes a plurality of equally spaced vanes 32' on left and right paddles 28*a*', 28*b*' to assist in propulsion of the toy vehicle 10' in water or loose terrain. To further assist in traction, a second pair of left and right paddles 128*a*, 128*b* with vanes 134 are provided outside left and right paddles 28', 28*b*'. For additional traction, particularly on pavement, elastomeric ring 30 preferably has been replaced by a first identical pair of inner tires 130 and a second identical pair of outer tires 132, which are located on either axial side of each of the left and right paddles 28', 28*b*'. Preferably too, identical reinforcement hubs 136 are provided to receive and support the left and right paddles 28', 28*b*' with outer tires 132 and to capture the inner tires 130 between themselves and the rotation rings 122. The resulting half wheel assemblies 120*a*, 120*b* are preferably secured together by being secured to the ends of power shaft 142 by suitable means such as depicted identical screw fasteners 135.

Further, reinforcement hubs 136 are hollow and may be sealed or, more preferably, filled with a foam material to make the toy vehicle 10' more buoyant in water. Other sealed hollow chambers or foam filled spaces can be provided in vehicle 10' for further buoyancy. For example, separate pontoons 60*a*, 60*b* are preferably provided within fenders 22*a*', 22*b*' and spaces within the pontoons and/or other spaces in the fenders can be filled with foam as can any space between the chassis 12' and the protective cover 22'. Additionally, a rear fender 22*c*' is coupled via a bracket 22*d*' to the cover 22' and/or chassis 12' to cover the rear wheel 20' to prevent water from being thrown forward over the vehicle 10' during use.

The toy vehicle 10' of the second preferred embodiment includes a battery door 105 to enclose a power supply within the central chassis 12'. Preferably, a battery pack 107 of other power supply provides power to the steering servo 54' and the motor 36'. Furthermore, it is preferred that the toy vehicle 10' have a conventional remote control electronics. For example, referring to FIG. 13, the toy vehicle 10' is controlled via radio (or other wireless) signals from the remote control transmitter 60. However, other types of controllers may be used including other types of wireless controllers (e.g., infrared, ultrasonic and/or voice-activated controllers) and even wired controllers and the like, with vehicle 10' or 10.

The toy vehicle 10' (and vehicle 10) is provided with control circuitry 100 preferably mounted on a conventional circuit board 101 (in phantom). For example, circuit board 101 can be disposed within the central chassis 12' or any other suitable location within the toy vehicle 10'. Referring to FIG. 13, the control circuitry 100 preferably includes a controller 102 having a wireless signal receiver 102*b* and a microprocessor 102*a* plus any necessary related elements such as memory. The steering servo 54' and the propulsion drive motor 36', are each respectively controlled by the microprocessor 102*a* through motor control subcircuits 104*a*, 104*b*, which, under control of microprocessor 102*a*, selectively couples the motor 36' and servo 54' with an electric power supply 106 (e.g. one or more disposable or rechargeable batteries or battery pack) in an appropriate direction. Preferably the power supply 106 can provide a current of at least 10 to 12 amps (and bursts of 15 amps) when is fully charged.

In operation, the wireless remote control transmitter 60 sends signals to the toy vehicle 10' that are received by the wireless signal receiver 102*b* via antenna 103. The wireless signal receiver 102*b* is in communication with and is operably connected with the servo 54' and the propulsion drive motor 36' through the microprocessor 102*a* and subcircuits 104*a*, 104*b* for controlling speed and maneuvering of the toy vehicle 10'. Operation of the servo 54' controls the roll of the rear wheel 20' and yaw of the front suspension 10'. Operation of the propulsion drive motor 36' serves to rotate the toy vehicle's 10 drive shaft 177, thus controlling its speed and, if applicable, its forward and rearward direction. The drive motor 36', servo 54' and respective couplings are preferably conventional and known in the art and a detailed description of their structure and operation is not necessary for a complete understanding of the present invention. However, exemplary drive motors can include brushless electric motors, preferably providing a minimum of 1,360 revolutions per minute per volt.

It will be appreciated by those skilled in the art that changes could be made to the embodiment described above without departing from the broad inventive concept thereof. For example, although the invention is described herein in terms of the preferred, three wheeled embodiment, the present invention could also comprise a vehicle having an additional rear wheel or only one front wheel. While the front wheels 18*a*', 18*b*' are fixed to the front suspension 14' the wheels 18*a*', 18*b*' could be pivotally supported by king pins or the like (not depicted) in a conventional manner on the chassis 12' and rotated side to side by a steering link or bar (not depicted), that could be moved side to side by crank 143. However, it should be appreciated that pivoting the front wheels 18' with the front fenders 22*a*', 22*b*' and pontoons 160 presents a greater area to the water than just the front wheels 18' to better steer the toy vehicle 10' in water. Furthermore, since the front suspension and wheels are pitched together while pivoting, both the front wheels remain level with one another as the rear wheel pitches. The toy vehicle 10, 10' can be constructed of, for example, plastic or any other suitable material such as metal or composite materials. Also, the dimensions of the toy vehicle 10, 10' shown can be varied, for example making components of the toy vehicle smaller or larger relative to the other components. It should also be appreciated that some of the figures are more schematic than others. It is understood, therefore, that changes could be made to either embodiment 10, 10' of the toy vehicle described above without departing from the broad inventive concept thereof. It is understood, therefore, that this invention is not limited to the particular embodiment disclosed, but is intended to cover modifications within the spirit and scope of the present application.

What is claimed is:

1. A motorized toy vehicle comprising:

a chassis with opposing, top and bottom sides and opposing, first and second longitudinal ends and a central plane extending in a vertical direction and a longitudinal direction through the chassis and at least generally bisecting the sides and ends;

first and second wheels mounted for rotation on a front suspension, the front suspension being coupled with the chassis proximal the first end so as to pivot with respect to the chassis and steer the first end, the first and second wheels being located on opposite sides of the central plane and remaining coaxially fixed with respect to one another on the front suspension as the front suspension pivots on the chassis;

a third wheel coupled with the chassis proximal the second end so as to span the central plane and pivot with respect to the chassis at least on an axis located in the central plane and extending parallel to the central plane, pitched at an angle between vertical and longitudinal directions; and a steering coupling mechanically connecting the first and second wheels with the third wheel to simultaneously pivot the first, second and third wheels with respect to the chassis so as to steer the toy vehicle at the first and second ends of the chassis to turn the toy vehicle in a selected direction.

2. The toy vehicle of claim 1 further comprising a steering servo operably connected with the steering coupling to drive the steering coupling and pivot the first, second and third wheels and further comprising a power source and control circuitry within the toy vehicle, the control circuitry including a controller with a wireless signal receiver and a subcircuit operably controlled by the controller so as to selectively couple the steering servo with the power supply and thereby controllably selectively pivot the first, second and third wheels to controllably and selectively steer the toy vehicle by wireless signal.

3. The toy vehicle of claim 1 wherein the third wheel is further coupled with the chassis so as to pivot with respect to the chassis at an axis located outside the third wheel and at least generally perpendicular to the central plane with the third wheel oriented vertically so as to be bisected by the central plane.

4. The toy vehicle of claim 1 further comprising a drive motor operatively coupled with the third wheel to drive the third wheel to rotate about a central rotational axis of the third wheel and propel the toy vehicle.

5. The toy vehicle of claim 4 wherein the third wheel and the drive motor are further coupled with the chassis so as to pivot together with respect to the chassis at an axis transverse to the central plane and displaced in the central plane from the central rotational axis of the third wheel.

6. The toy vehicle of claim 4 further comprising a rear suspension supporting the third wheel to pivot with respect to the chassis about an axis located in the central plane extending parallel to the central plane, the rear suspension including a hub stationary in the third wheel and wherein the third wheel comprises a pair of half wheel assemblies located on opposite sides of the hub and fixedly coupled together so as to be supported for rotation together with respect to the hub on the hub.

7. The toy vehicle of claim 6 further comprising a drive coupling extending from the drive motor located outside the third wheel radially between the pair of half wheel assemblies and into the hub.

8. The toy vehicle of claim 1 wherein the toy vehicle further comprises a rear suspension including a hub centered and stationary in the third wheel and wherein the third wheel includes a pair of half wheel assemblies located on opposite axial ends of the hub and fixedly coupled together so as to be supported for rotation together with respect to the hub on the hub.

9. The toy vehicle of claim 1 further comprising a drive motor operably coupled with the third wheel to rotate the third wheel to propel the toy vehicle with the third wheel; and a rear suspension supporting the third wheel for rotation about a central wheel axis and supporting the third wheel and the motor to further pivot with respect to the chassis at the axis located in and parallel to the central plane.

10. The toy vehicle of claim 1 wherein the steering coupling comprises a rear pivot shaft having a centrally located rear pivot axis, both extending along the central plane in a direction pitched forwardly away from the vertical, the rear pivot shaft supporting the third wheel from the chassis so as to pivot with the third wheel in a roll direction with respect to the chassis about the rear pivot axis.

11. The toy vehicle of claim 10 wherein the third wheel is supported for rotation on a rear suspension and wherein the rear suspension is coupled with the rear pivot shaft to support the rear wheel on the rear pivot shaft so as to pivot with the third wheel in a roll direction with respect to the chassis about the rear pivot axis.

12. The toy vehicle of claim 11 wherein the rear suspension is further pivotally coupled with respect to the rear pivot shaft so as to pivot with the third wheel in pitch direction with respect to the chassis and the rear pivot shaft about a pitch axis located outside the third wheel and extending perpendicularly to the rear pivot axis spaced transversely away from the rear pivot shaft.

13. The toy vehicle of claim 12 wherein the first and second wheels are mounted for rotation on a front suspension, the front suspension being mounted to the chassis to pivot on a front pivot axis extending along the central plane pitched away from the vertical, the first and second wheels remaining coaxial on the front suspension with the front suspension pivoted on the front pivot axis.

14. The toy vehicle of claim 13 wherein the steering coupling further comprises a pivotal connection between the rear pivot shaft and the front suspension.

15. The toy vehicle of claim 14 further comprising a steering servo rotatably connected with the rear pivot shaft to pivot the rear pivot shaft about the rear pivot axis and thereby drive the steering coupling to pivot the first, second and third wheels.

16. A wheeled toy vehicle comprising:

a chassis with opposing, top and bottom sides and opposing, first and second longitudinal ends and a central plane extending in a vertical direction and a longitudinal direction through the chassis and at least generally bisecting the sides and ends;

a first suspension mounted to the chassis proximal the first end on a first pivot shaft so as to pivot with respect to the chassis and steer the first end, first and second wheels mounted for rotation on opposite sides of the central plane on opposite ends of the first suspension to support the first longitudinal end of the chassis for movement along a support surface;

a third wheel centrally located proximal the second longitudinal end of the chassis;

a second suspension mounting the third wheel for rotation so as to support the second longitudinal end of the chassis for movement along the support surface, the second suspension being mounted to the chassis proximal the second end by a second pivot shaft so as to pivot with the third wheel with respect to the chassis about the second pivot shaft, each of the first and second pivot shafts being parallel to the central plane and pitch away from the vertical.

17. The toy vehicle of claim 16 further comprising a rotary coupling joining the second pivot shaft and the first suspension so as to pivot simultaneously pivot the first suspension about the first pivot shaft with the rear suspension about the second pivot shaft and steer the vehicle simultaneously at the first and second longitudinal ends.

18. The toy vehicle of claim 17 wherein the second suspension and the third wheel are coupled with the second pivot shaft by a third pivot shaft extending perpendicularly to the first and second pivot shafts so as to permit the second suspension and third wheel to pivot in a pitch direction with respect to the chassis and second pivot shaft.

19. The toy vehicle of claim 17 further comprising a steering servo rotatably coupled with the second pivot shaft, a power source and control circuitry within the toy vehicle, the control circuitry including a controller with a wireless signal receiver and a subcircuit operably controlled by the controller so as to selectively couple the steering servo with the power supply and thereby controllably pivot the first, second and third wheels to controllably steer the toy vehicle by wireless signal.

20. The toy vehicle of claim 17 further comprising a drive motor supported on the second suspension to pivot with the second suspension and third wheel with respect to the chassis, and a separate subcircuit controlled by the controller so as to selectively couple the drive motor with the power supply and thereby rotate the third wheel to propel the toy vehicle.

* * * * *